US005734222A

United States Patent [19]

Callaghan

[11] Patent Number: 5,734,222

[45] Date of Patent: Mar. 31, 1998

[54] SPARK PLUG SYSTEM

[75] Inventor: Daniel Clive Callaghan, Edgecliff, Australia

[73] Assignee: Sixes and Sevens Pty Ltd, Australia

[21] Appl. No.: 605,099

[22] PCT Filed: Jun. 19, 1994

[86] PCT No.: PCT/AU95/00352

§ 371 Date: Mar. 1, 1996

§ 102(e) Date: Mar. 1, 1996

[87] PCT Pub. No.: WO96/01512

PCT Pub. Date: Jan. 18, 1996

[30] Foreign Application Priority Data

Jul. 1, 1994 [AU] Australia ..... PM6571

[51] Int. Cl.[6] ..... H01T 13/20

[52] U.S. Cl. ..... 313/141; 313/140; 313/141

[58] Field of Search ..... 313/139, 143, 313/141

[56] References Cited

U.S. PATENT DOCUMENTS

| | | | |
|---|---|---|---|
| 4,644,218 | 2/1987 | Kirkhouse | 313/143 |
| 4,736,718 | 4/1988 | Linder | 313/143 |

FOREIGN PATENT DOCUMENTS

| | | |
|---|---|---|
| 1452623 | 1/1924 | Australia . |
| 6082980 | 6/1981 | Australia . |
| 69993 | 7/1982 | European Pat. Off. . |
| 1031976 | 6/1953 | France . |
| 193787 | 3/1923 | United Kingdom . |
| 212635 | 3/1924 | United Kingdom . |

OTHER PUBLICATIONS

Certified Translation of EP 69993.

Certified Translation of FR 1031976.

International Search Report for PCT/AU95/00352 (for which priority is claimed).

*Primary Examiner*—Sandra L. O'Shea

*Assistant Examiner*—Joseph Williams

*Attorney, Agent, or Firm*—Price, Heneveld, Cooper, Dewitt & Litton

[57] ABSTRACT

A spark plug system (20) incorporating a spark plug and an associated venturi passage (38), said spark plug being spaced from the venturi passage (38) and projecting outwardly from one end thereof; and an electrode member (32) surrounding one end of an insulator member (21) which in mm surrounds and is spaced from a main electrode (23) carried by the insulator member (21) with at least the tip of said main electrode (23) being so positioned whereby to create sparks between itself and the surrounding electrode member (32). The electrode member (32) is so shaped to define, with the insulator member (21), a pre-combustion chamber (30) surrounding the main electrode (23). The electrode member (32) has at least one aperture (29) related in space to the tip of the main electrode (23) of the insulator member (21) and the associated venturi passage (38), and such as to allow communication between the cylinder chamber of an associated engine and the pre-combustion chamber.

9 Claims, 2 Drawing Sheets

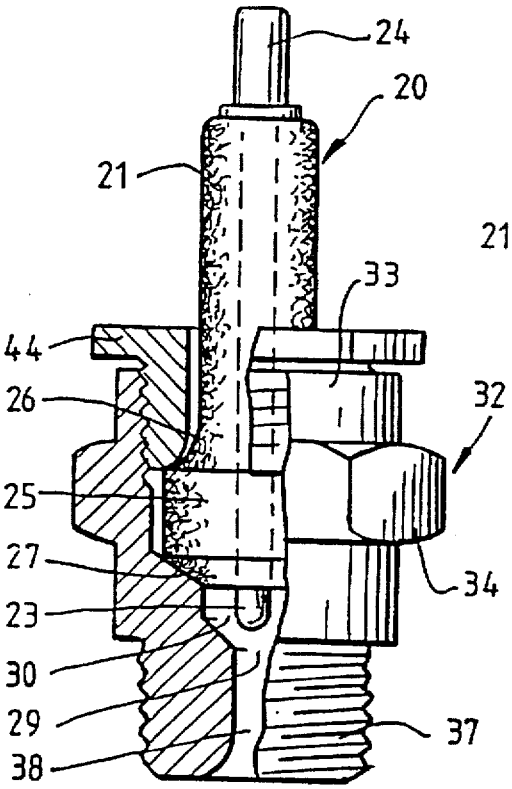
FIG. 1
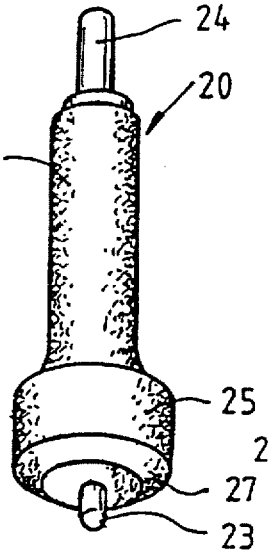
FIG. 2
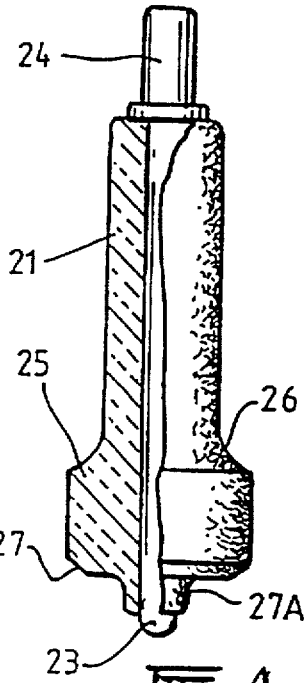
FIG. 4
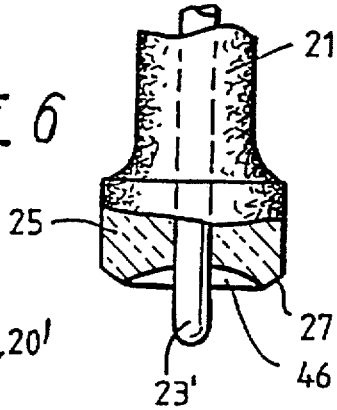
FIG. 6
FIG. 3
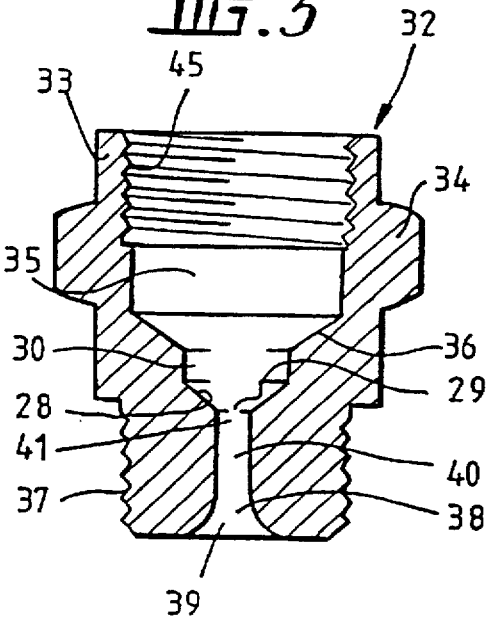
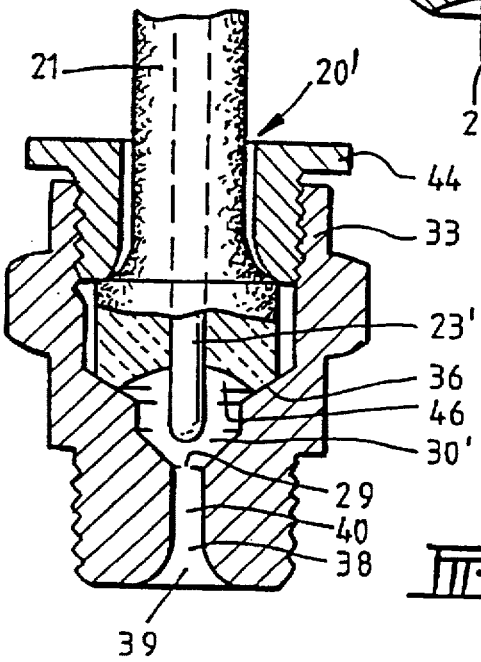
FIG. 5

SPARK PLUG SYSTEM

This application is a 371 of PCT/AU95/00352, filed Jun. 19, 1995.

TECHNICAL FIELD

The present invention relates to an improved spark plug system, and in particular, but not exclusively, to a spark plug system for an internal combustion engine.

BACKGROUND ART

Conventional spark plug systems suffer from a number of disadvantages, resulting in inefficient, ineffective and/or uneven combustion at or in the vicinity of the associated cylinder of the internal combustion engine, one result of which can be the build-up of undesirable carbon and/or other impurities on the electrodes of the spark plug system ultimately affecting the overall operation of the spark plug system. Known spark plug systems also have a tendency to produce undesirable "pre-ignition". Furthermore, known spark plug systems can be somewhat unreliable in "firing"unless the conditions prevailing in their immediate vicinity are correct, for example, burnt gases or lean mixtures prevent fire propogation.

Conventional spark plugs have also been found to suffer from heat transfer problems, particularly when associated with high-performance engines where the plug system often results in undesirable over heating, and ultimately, damage to the insulator body of the plug.

As one example of known spark plug systems, attention is directed to Australian Patent Specification No. 159,863 which discloses a spark plug fitted with an adaptor defining a precombustion chamber. The spark plug employed therein was of a conventional design capable of working normally without the adaptor, although without the adaptor the plug suffered in performance as a result of the loss of the anti-fouling capability achieved with the adaptor. However, such a combination of spark plug and adaptor has now been found to result in a long heat transfer path, and with the advent of more sophisticated high-performance engines, arrangements such as those disclosed in the Patent Specification No. 159,863 have been found to suffer as a result of the undesirable over-heating referred to above.

The present invention seeks to alleviate the problems and disadvantages associated with known spark plug systems, and to provide a spark plug which will allow for more, faster and even combustion of the combustible gases in the cylinder of an associated internal combustion engine.

DISCLOSURE OF THE INVENTION

The spark plug system of the present invention incorporates means to define a special precombustion chamber for initial or preliminary combustion of combustible gases and for subsequently spreading the combustion with a desired rapidity, all without increasing the effective overall size, including the length, of the spark plug system. In fact, with the system in accordance with the present invention, it is possible to reduce or increase the overall size, including the length, of the spark plug system. In particular the diameter of the system allows more freedom in cylinder design and valve numbers and disposition and/or size, for better performance of the engine. The spark plug system in accordance with the present invention furthermore minimises, if not eliminates altogether, the problems involved with overheating In accordance with the present invention there is provided a spark plug system incorporating a spark plug and an associated venturi passage, said spark plug being spaced from the venturi passage and projecting outwardly from one end thereof; and an electrode member surrounding one end of an insulator member which in turn surrounds and is spaced from a main electrode carried by said insulator member with at least the tip of said electrode being so positioned whereby to create sparks between itself and said surrounding electrode member; wherein said electrode member is so shaped to define, with the insulator member, a precombustion chamber surrounding the electrode, said electrode member having at least one aperture related in space to the tip of said main electrode of said insulator member and said associated venturi passage, and such as to allow communication between the cylinder chamber of an associated engine and said precombustion chamber.

Preferably an annular ring of sparks is created between the electrode and surrounding electrode member.

Preferably the electrode member is also an adaptor with which the insulator member is associated and in which the venturi passage is provided, or alternatively the electrode member my be provided by the cylinder block of an associated engine and in which a port for receiving the spark plug has an associate venturi passage.

Apart from defining the precombustion electrode chamber for the spark plug, the effect of which will be later described, the electrode member also performs the function of an earth electrode completely surrounding the electrode; assists in cooler operation of the plug in a manner to be later discussed; and also functions as a massive metal bank for electron vaporisation when an annular ring of sparks is created—providing art enormous longevity of the electrodes of which the spatial characteristics are very important.

BRIEF DESCRIPTION OF THE DRAWINGS

Several preferred embodiments of the invention will now be described with reference to the accompanying drawings, in which:

FIG. 1 is a partly sectioned side elevational view of a first embodiment of the spark plug system in association with an adaptor providing an axial venturi passage and adapted to by received in the conventional spark plug port in the cylinder head of an internal combustion engine;

FIG. 2 is a perspective view of the insulator-electrode of the spark plug system of FIG. 1;

FIG. 3 is a cross-sectional side elevational view of the adaptor of FIG. 1;

FIG. 4 is a partly sectioned side elevation of a variation of the insulator and electrode member;

FIG. 5 is a partly sectioned side elevational view of a second embodiment of the insulator/electrode combination of the spark plug system in association with an adaptor the same as the previous embodiment;

FIG. 6 is a partly sectioned side elevational view of the insulator/electrode combination of the spark plug system of FIG. 5;

BEST MODES FOR CARRYING OUT THE INVENTION

Figure 7:
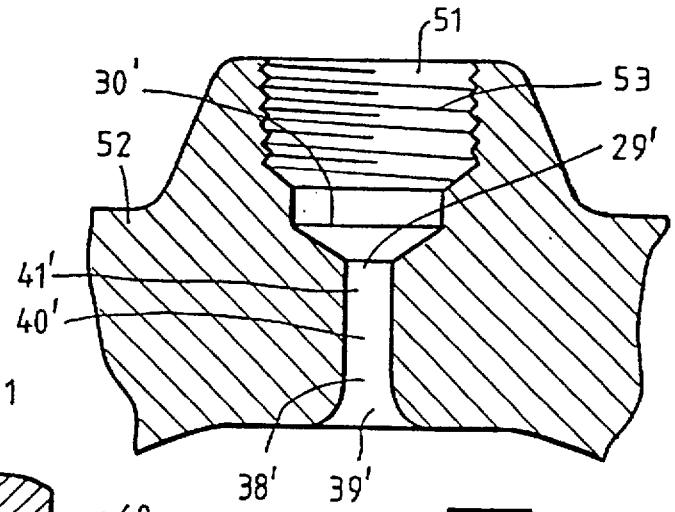
FIG. 7 is a sectional view of a modified form of cylinder head configuration at the spark plug port and incorporating an axial venturi passage as an alternative to the adaptor with which the spark plug system is associated in the preceding embodiments.

Referring to FIGS. 1 to 3 of the drawings, the first embodiment of the spark plug system of this invention, and generally designated as 20, includes an insulator member 21 of cylindrical configuration and a conductor disposed centrally therethrough and projecting outwardly from one end as shown to provide the main electrode 23 and extending outwardly from the other end to provide a conventional electrical connector terminal 24. The insulator member 21 at its end adjacent the main electrode 23 is enlarged as shown to provide a cylindrical section 25 of larger diameter than the remainder of the body, a radiused taper section 26 between the cylindrical section 25 and the remainder of the insulator body, and a further frusto-conical section 27 adjacent the main electrode 23. The remaining component of the spark plug system is provided by an earthed electrode member 32, and has a female conical section 36 which matches the conical section 27 of the insulator member 21 so as to provide a seat thereon when the insulator member is placed in position and locating accurately and axially the main electrode 23 as shown in FIG. 1. The earthed electrode member 32 has a centrally disposed aperture 29 at the apex thereof adjacent which the main electrode 23 is positioned so the tip of the electrode 23 is substantially in alignment therewith at a predetermined distance.

The diameter of the central aperture 29 is greater than the diameter of the main electrode 23 whereby to form an annular spark gap extending completely around the main electrode. When in position, a space is formed between a conical section 28 within the electrode member 32 and the aperture 29 to define a precombustion chamber 30 between the electrode member and the end of the insulator body 21 and surrounding the main electrode 23. In an alternative embodiment the conical section 28 defining a frusto-concial internal wall within the electrode member 32 may be curved to define a curved internal wall, and the aperture associated with the electrode 23 is provided through the curved internal wall. The conical section 36 of the electrode member 32 is so positioned relative to the central aperture 29 that, when placed in position and aligned with the insulator member 21, the aperture will be in direct fluid communication with the precombustion chamber 30.

The spark plug system of this embodiment is, in use, associated with the electrode member 32 whereby the electrode member also acts as an adaptor. The adaptor has a cylindrical main body portion 33 about which a hexagonal flange 34 is formed for engagement by a suitable tool during fitting of the adaptor member to the spark plug port of an associated cylinder head. The remainder of the adaptor member consists of an externally threaded extension 37 complementing the internally threaded spark plug port of an associated cylinder head. The adaptor member has an axial passage therethrough shaped to provide a large diameter chamber 35 adapted to receive the enlarged end of the spark plug system 20; and the frusto-conical portion 36 angled to mate with the angle of the conical electrode section 27 of the insulator of the spark plug system such that, conical portion 36 of the electrode member 32 will be firmly clamped and sealed against the frusto-conical section 27 of the insulator body when the spark plug system is inserted within the adaptor as shown in FIG. 1.

With this particular adaptor, the aperture 29 forms part of a venturi passage 38 extending through the threaded extension 37 and opening outwardly through the end of the adaptor. The venturi passage 38 further consists of an outer tapered section 39, an intermediate throat section 40 and an inner cylindrical throat section 41. The extension 37 is chambered at the extremity and is shaped to create and enhance turbulence in the cylinder, reduce and diffuse fuel/air mix supply to the axial passage.

As shown in FIG. 1, the spark plug system 20, comprising the insulator member 21 and the electrode member 23, and in accordance with this preferred form of the invention, is positioned within the adaptor/electrode member 32 and retained in place by an annular retaining ring 44 having an external thread cooperating with an internally threaded section 45. This could be replaced by a cement received within a swaged metal section of member 32 in mass production and within a chamber in the adaptor/electrode member.

The other embodiments of the invention shown in FIGS. 5 and 6, represent a modified form of spark plug system 20' and in which the same reference numerals have been used to identify features identical with those of the first embodiment. The adaptor/electrode member 32 is identical, in all respects with the adaptor associated with the spark plug system of the first embodiment, and the same reference numerals are used to identify its constructional details.

However, in this embodiment, the central main electrode 23' can be altered and the end of the insulator body 21 is shaped to provide a concave cavity 46. The electrode member 23' defines, with the cavity 46, a precombustion chamber 30' which, as with the first embodiment, communicates with the venturi passage 38 within the adaptor member 32.

In the third embodiment of the invention shown in FIG. 4, the end of the insulator body is altered to provide a portion **27*a* which extends along the electrode 23 to a point where only a small tip is available to provide sparking and the electrode is thus kept more isolated in the precombustion chamber 30 defined by the surrounding structure including portion 27*a*** of the insulator body.

In the embodiments described above, the spark plug systems are, in-use, associated with an adaptor/electrode member within which the insulator body 21 is received and in which the venturi passage is provided.

In the preceding embodiments the electrode/adaptor 32 is received in the conventional spark plug port in the cylinder head of an internal combustion engine. As an alternative, the spark plug port through the cylinder head my be modified to provide a venturi passage 38', whereby the spark plug system may be received directly within the spark plug port with the cylinder head providing the surrounding electrode which together with the main electrode the spark gap is created.

Such a modified spark plug port configuration for the cylinder head of an internal combustion engine is shown in FIG. 7. As shown, the spark plug port 51 in the cylinder head 52 has an outer chamber 53 adapted to receive and retain either of the spark plug systems 20 or 20' of the preceding embodiments, that is, the insulator member and electrode member combinations 21, 23 of FIG. 2, or 21, 23' of FIG. 6, which dispenses with the requirement for an electrode/adaptor member as a separate integer or which retains the entire system of the embodiment of FIGS. 1 to 3. The spark plug port further includes the venturi passage 38' similar to that provided in the adaptor member of the preceding embodiments, and having outer section 39', an intermediate throat section 40', an aperture 29' and an inner cylindrical throat 41', opening at one end into the cylinder chamber of the engine and at the other end into the precombustion chamber 30' via aperture 29'.

Figure 8:
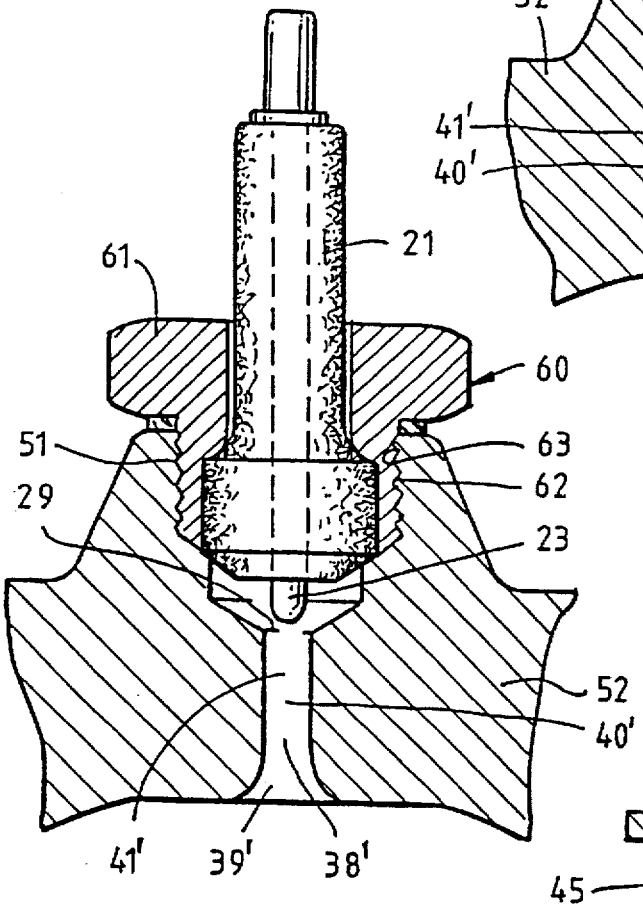
FIG. 8 is a cross-sectional view of the cylinder head of FIG. 7 with an insulator/electrode of the type shown in FIG. 2 received within the cylinder head in axially spaced relationship with the venturi passage within the cylinder head.

FIG. 8 of the drawings shows the spark plug system 21, 23 of FIG. 2 received within the modified cylinder head of FIG. 7, and which utilises a simple adaptor 60 with a hexagonal head 61 for engagement by a suitable tool and a threaded extension 62 adapted to be screwed into a correspondingly internal thread within an opening 63 in the cylinder head communicating with the venturi passage. The disposition of the adaptor 60, the spark plug system 20, 23 and the venturi passage are such that the precombustion chamber 30' as with the preceding embodiments is defined within the cylinder head. In the embodiment of FIG. 8 the electrode/adaptor member of FIGS. 1 to 3 is dispensed with and the cylinder head itself provides the electrode member.

Figure 9:
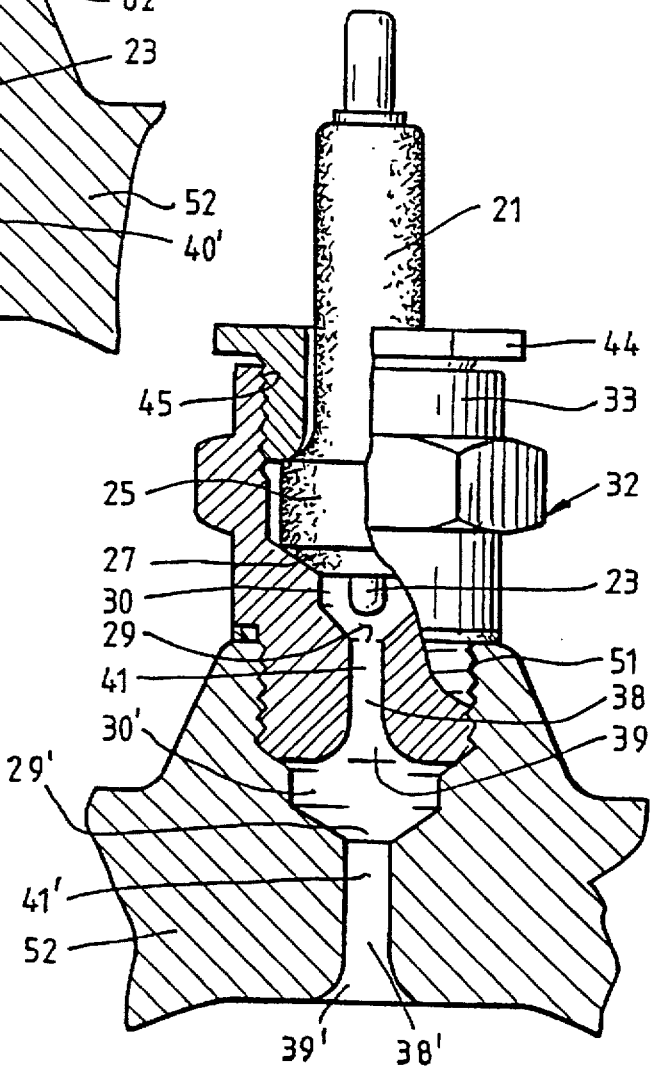
FIG. 9 is a cross-sectional view of the cylinder head of FIG. 7 with a spark plug and adaptor of the type shown in FIG. 1 received within the cylinder head and once again in axially spaced relationship with the venturi passage within the cylinder head.

FIG. 9 of the drawings shows an embodiment whereby the electrode/adaptor member of FIGS. 1 and 3 containing the spark plug system 21, 23 is retained and thus an extended precombustion chamber consisting of chambers 30 and 30' are provided, one 30 within the electrode/adaptor 32 and the other 30' within the cylinder head, together with their associated venturi passages 38 and 38' respectively and with their respective apertures 29 and 29'.

In the embodiments of the invention described above the main electrode is centrally disposed and spaced axially from the venturi passage and the distance between it and the surrounding electrode member (electrode/adaptor member or wall within the cylinder head) is equidistant enabling the creation of an annular ring of sparks. However, in other embodiments of the invention (not illustrated) the main electrode may be other than centrally disposed and/or the shape of the precombustion chamber being other than axially symmetrical, but as long as the distance between at least the tip of the main electrode and the wall of the surrounding combustion chamber is the same whereby to enable the creation of an annular ring of sparks.

The basic principle of operation of the spark plug system according to this invention will now be described with reference to the preferred embodiments.

Upon compression of combustible gases (charge) drawn into an associated cylinder during a preceding induction stroke, the combustible gases accumulate in the axial passages 38 (FIGS. 1 and 3) or 38' (FIGS. 7, 8 and 9) and also accumulate in the precombustion chambers 30 or 30' of the spark plug system 20 or 20' within the adaptor/electrode member 32 or within the cylinder head (FIGS. 7, 8 and 9). Upon subsequent ignition some of the combustible gas in the precombustion chamber immediately at and around the tip of the main electrode 23 will ignite, whereafter a majority of the charge between the tip of the main electrode and the electrode member will ignite. This fact has been confined by tests carried out where examination of the spark plug system after use has shown signs of detonation at the surface of the electrode member, whilst the face of the insulator body was dry and clean of burnt fuel. Simultaneously, combustion gases within the axial passage are ignited and are expanding behind a flame front (hereinafter referred to as the "initial front burn") moving through the venturi passage and into the cylinder chamber and the ignited and expanding gases within the precombustion chamber of the spark plug system (hereinafter referred to as the "major following burn") having no other avenue of escape rapidly flow outwardly through the venturi passage.

It will be observed that the electrode/adaptor member or the cylinder head forming part of the spark plug system of this invention, apart from providing one of the necessary pair of electrodes for the creation of a spark, provides the dominant heat transfer path directly to the cylinder head which assists in keeping the spark plug system cool as well as acting as the female section of the gas seal and receives the heat transfer from the insulator. Furthermore, as at least the tip of the main electrode is positioned accurately from the axis of the aperture in the surrounding electrode member a ring of sparks around 360° of the central electrode is produced providing more efficient and symmetrical ignition, which in turn is believed contributes to greater burning of the combustible gases in the cylinder as has been observed for engines fitted with spark plug systems in accordance with the present invention.

Additionally, the large electrode surface area and symmetrical annular ignition provides for even electron vaporisation (or metal erosion) without dramatically altering the clear and defined spark gap for the life of the spark plug system without the necessity to use special, in some cases expensive, material. Where the spark plug system is associated with a venturi passage as incorporated in the adaptor of FIGS. 1 and 3 (venturi passage 38) or in the spark plug ports in FIG. 7 (venturi passage 38'), an additional effect maybe achieved, as follows. As the combusted gases from the "initial front burn" move out of he venturi passage a partial vacuum, or at least a reduction in pressure, is generated in the venturi passage which has the effect of aiding an increase of the speed at which the products of the "major following burn" move through the venturi passage, and the net result is an increase in the velocity of the products of both burns through the venturi leading to a considerable reduction in pressure within the venturi passage and combustion chamber. Although it is not entirely clear how the double burn effect produces such a great increase in velocity and reduction in pressure in the venturi passage precombustion chamber, one possibility is that the high velocity of the products of the second burn cause it to catch up to the products of the first burn to act therewith and thrust them through the throat of the venturi. Another possibility is that the "major following burn" flows through the decomposed gases of the flame front of the first burn as it moves through the throat of the venturi. It is believed that the velocity of "initial front burn" accelerates from an initial speed in the order of 15 to 18 m/sec. to something in the order of 30 m/sec. approaching the throat of the venturi passage before being caught by the "major following burn" moving at a velocity of at least 100 m/sec. As a result of the considerably reduced pressure generated in the venturi and chamber after the flame enters the cylinder chamber leaving a vacuum or lower pressure in the precombustion chamber as the piston retreats within the associated cylinder. Then, as the cylinder is recharged, a prime or recharge of the venturi passage, and the precombustion chamber within the spark plug system occurs, and is heated whilst passing through the venturi to the precombustion chamber and further vaporised, ready for the next ignition stage, thus eliminating any time delay associated with priming the space adjacent the spark plug system during the next compression and ignition stage.

In general, the spark plug systems in accordance with the present invention exhibit capacity for a greater lifetime due to increased capacity of the electrode adaptor. The reduction of carbonisation or fouling of the electrodes by the self-cleaning effect of initial sparking and flame front also effectively eliminates the disadvantages of gradual loss of engine power and inefficient running generally associated with conventional spark plug systems. It is of interest that the faster the engine revolutions the better the flaming and performance of the spark plug system and the cleaner at least the cylinder head of the engine becomes in normal usage.

In practical terms the arrangements in accordance with the present invention has been found to give rise to substantial improvements in at least one of six performance parameters of an internal combustion engine in normal operating conditions of the engine, either mobile or stationary, namely:

1. A more complete combustion of the fuel supplied to the combustion chamber regardless of the type of fuel commonly used in internal combustion engines;
2. Cleaning of the combustion chamber;
3. Increase in engine power;
4. Reduction of the octane requirement of the fuel;
5. Reduction of fuel consumption; and
6. Reduction of at least some pollutants, being hydrocarbons, carbon monoxide and nitrous oxides.

Both the exhaust and induction strokes for the motor or engine will be normal in all respects where a venturi passage is utilised, and no burnt gases will be left in such a passage. It has been found that the only adjustment required to be made to any engine in order to accommodate spark plugs in accordance with the invention may be in regard to the timing and fuel supply for carburetted engines and the engine management system of computer fuel-supplied engines. To be more specific it has been found preferable to adjust the timing, dependent on the model, by from between 5 and 35 degrees in order to take advantage of the negative pressure of the intake manifold vacuum and take up or absorb the time gap caused by the precombustion of the fuel and the subsequent firing of the mixture by means of a flame instead of a spark and the most effective piston position in the firing cycle related to power output.

I claim:

1. A spark plug system incorporating a spark plug and an associated venturi passage, said spark plug being spaced from the venturi passage and projecting outwardly from one end thereof; and an electrode member surrounding one end of an insulator member and which also surrounds and is spaced from a main electrode carried by said insulator member with at least the tip of said main electrode being so positioned whereby to create sparks between itself and said surrounding electrode member; wherein said electrode member includes a continuous passage therethrough which is so shaped to define, with the insulator member, a pre-combustion chamber surrounding and wholly enclosing the tip of the main electrode, said venturi passage also forming part of said continuous passage and having at least one aperture related in space to the tip of said main electrode of said insulator member and said associated venturi passage, and such as to allow communication between the cylinder chamber of an associated engine and said pre-combustion chamber, and with the tip of said main electrode terminating short of or at the narrowest point of the venturi passage.

2. A spark plug system as claimed in claim 1, wherein at least the tip of said main electrode is so positioned relative to said surrounding electrode member whereby to create an annular ring of sparks.

3. A spark plug system as claimed in claim 1, wherein said insulator member has a cavity formed in one end thereof adjacent said main electrode, and said electrode member is of frusto-conical internal configuration providing an internal frusto-conical wall, and said aperture associated with said main electrode is an aperture provided through said wall.

4. A spark plug system as claimed in claim 1, wherein said insulator member defines part of said precombustion chamber, said electrode member has a curved internal wall, and said aperture associated with said main electrode is an aperture provided through said curved internal wall.

5. A spark plug system as claimed in claim 1, wherein said insulator member has an end wall and a raised central portion surrounding the electrode within the precombustion chamber.

6. A spark plug system as claimed in claim 1, wherein said electrode member is located on a surface of said insulator member surrounding and spaced from said electrode whereby, in use, said electrode member bears against a mating surface surrounding the adjacent end of said main venturi passage.

7. A spark plug system as claimed in claim 1, further comprising an adaptor member through which said venturi passage is provided, and wherein said one end of said spark plug is received and retained within a chamber within said adaptor and communicating with said venturi passage and an associated engine cylinder.

8. A spark plug system as claimed in claim 1, wherein in said associated venturi passage is provided in a spark plug port of part of an associated engineer cylinder body.

9. A spark plug system incorporating a spark plug and an associated venturi passage, said spark plug being spaced from the venturi passage and projecting outwardly from one end thereof; and an electrode member surrounding one end of an insulator member which in turn surrounds a main electrode carried by said insulator member with at least the tip of said main electrode being positioned to create sparks between itself and said surrounding electrode member; wherein said electrode member is so shaped to define, with the insulator member, a pre-combustion chamber surrounding the main electrode, said electrode member having at least one aperture related in spaced to the tip of said main electrode of said insulator member and said associated venturi passage to allow communication between the cylinder chamber of an associated engine and said pre-combustion chamber, said main electrode terminating short of or at the narrowest point of the venturi passage, and wherein the venturi passage is defined by said electrode member.

* * * * *

UNITED STATES PATENT AND TRADEMARK OFFICE

CERTIFICATE OF CORRECTION

PATENT NO. : 5,734,222
DATED : March 31,1998
INVENTOR(S) : Daniel Clive Callaghan It is certified that error appears in the above-identified patent and that said Letters Patent is hereby corrected as shown below: On the title page,

[22] PCT Filed: "Jun. 19, 1994" should be --Jun. 19, 1995--.

Am. A, Abstract, Line 6;
"mm" should be --turn--.

Column 2, Line 33;
"art" should be --an--.

Column 2, Line 41;
"by" should be --be--.

Column 3, Line 40;
"frusto-concial" should be --frusto-conical--.

Column 4, Line 43;
"in-use" should be --in use--.

Column 5, Line 54;
"confined" should be --confirmed--.

Column 6, Line 26;
"maybe" should be --may be--.

Column 6, Line 27;
"he" should be --the--.

UNITED STATES PATENT AND TRADEMARK OFFICE

CERTIFICATE OF CORRECTION

PATENT NO. : 5,734,222
DATED : March 31,1998
INVENTOR(S) : Daniel Clive Callaghan It is certified that error appears in the above-identified patent and that said Letters Patent is hereby corrected as shown below:

Column 7, Line 6;
"has" shuld be --have"

Column 7, Claim 1, Lines 56;
After the word "passage" and before the ".", insert --, and wherein the venturi passage is defined by said electrode member,--.

Column 8, Claim 8, Line 35;
"engineer" should be --engine--.

Column 8, Claim 9, Line 46;
"spaced" should be --space--
Column 5, Line 54;
"confined" should be --confirmed--.

Signed and Sealed this

Thirteenth Day of July, 1999

*Attest:*

Q. TODD DICKINSON

*Attesting Officer*

*Acting Commissioner of Patents and Trademarks*